US006725521B1

(12) United States Patent
Blacket et al.

(10) Patent No.: US 6,725,521 B1
(45) Date of Patent: Apr. 27, 2004

(54) FASTENING OF SHEET MATERIAL

(75) Inventors: Stuart Edmund Blacket, Closeburn (AU); Nicholas Richard Clew, Farmington Hills, MI (US)

(73) Assignee: Henrob Limited (GB)

( * ) Notice: Subject to any disclaimer, the term of this patent is extended or adjusted under 35 U.S.C. 154(b) by 0 days.

(21) Appl. No.: 09/856,092

(22) PCT Filed: Nov. 17, 1999

(86) PCT No.: PCT/GB99/03823

§ 371 (c)(1),
(2), (4) Date: Aug. 22, 2001

(87) PCT Pub. No.: WO00/29145

PCT Pub. Date: May 25, 2000

(30) Foreign Application Priority Data

Nov. 17, 1998 (GB) ..... 9825119
Aug. 23, 1999 (GB) ..... 9919854

(51) Int. Cl.[7] ..... B23P 11/00
(52) U.S. Cl. ..... 29/432.2; 29/521; 29/798
(58) Field of Search ..... 29/798, 432, 432.1, 29/432.2, 505, 818, 243.53, 283.5, 521

(56) References Cited

U.S. PATENT DOCUMENTS 3,615,274 A 10/1971 Belada
4,726,504 A 2/1988 Halbert
5,051,020 A 9/1991 Schleicher
5,752,305 A * 5/1998 Cotterill et al. ..... 29/432.2
6,276,050 B1 * 8/2001 Mauer et al. ..... 29/243.53
6,385,843 B1 * 5/2002 Singh et al. ..... 29/798

FOREIGN PATENT DOCUMENTS

WO WO 94/14554 7/1994

* cited by examiner

*Primary Examiner*—David P. Bryant
(74) *Attorney, Agent, or Firm*—Piper Rudnick LLP

(57) ABSTRACT

A fastener such as a self piercing rivet (1) is inserted into sheet material (19) without full penetration such that the deformed end of the rivet remains encapsulated by an upset annulus of the sheet material (19). The sheet material (19) is clamped between a nose (17) and a die (16) of a riveting machine. Once the sheet material (19) is clamped, the distance between the nose (17) and the die (16) is controlled during the riveting operation by a restraint device (20, 23). This technique ensures that reaction forces generated in the joint between the nose (17) and the die (16) during riveting are absorbed in the joint as compressive stresses during the riveting operation so that the resulting joint has improved fatigue life. Furthermore, the rivet insertion load imparted into the C frame as a reaction force is applied back into the joint as a post rivet-insertion clamping load. Alternatively, a separate clamping force is applied after the rivet (1) has been inserted.

7 Claims, 5 Drawing Sheets

STATIONARY
ADVANCE
RETRACT
POSITION 1
POSITION 2
POSITION 3
POSITION 4
POSITION 5
POSITION 6
POSITION 7
POSITION 8
D
S
R 72
85
73
86

ADVANCE
72
74
73
D
POSITION 5

ADVANCE
73
74
S
POSITION 4

ADVANCE
73
R
74
POSITION 3

ADVANCE
73
POSITION 2

STATIONARY
80
72
85
79
74
73
75
R
POSITION 1

FASTENING OF SHEET MATERIAL

The present invention relates to a method and apparatus for fastening sheet material by self-piercing riveting or clinching. The term "clinching" is also known as "press joining" or "integral fastening".

Methods and apparatus for riveting of the kind in which a self-piercing rivet is inserted into sheet material without full penetration, such that the deformed end of the rivet remains encapsulated by an upset annulus of the sheet material are known.

FIG. 1 is a diagrammatic section of an example of a riveted joint made by such a riveting method in accordance with the invention. A rivet 1 has a head 2 and a shank 3 terminating in an annular edge 4. The shank 3 is initially cylindrical but is flared outwardly into the illustrated shape as the rivet is driven into two overlapping sheets 5,6 located on a suitably shaped die. As shown, the shank and the edge of the rivet 1 remain embedded in the sheet material 5,6 after the rivet has been set.

An improved self-piercing riveting method is described in our European Patent No. 0675774. In this method the sheet material is clamped with substantial force during the riveting operation between a nose of the riveting machine and the die in the region around the rivet insertion location so that there is minimal distortion of the sheet material during the riveting operation. This method has been proved to increase the strength of the riveted joint and reduce the depth of the annular valley 7. However, the relatively high level of clamping force required to achieve the improved joint characteristics means that a significant pressure of hydraulic fluid or a heavy-duty spring is required to apply the force. Furthermore, if reaction forces within the joint resulting from rivet insertion exceed the clamping force, the nose will be pushed back up away from the die. This results in a reduction of the potential residual compressive stress that could be imparted to the region around the rivet.

Joining two sheets of metal by clinching is known, whereby two sheets of metal are deformed into locking engagement using a punch-and-die combination.

An improved clinching method is described in our European Patent No. 0614405. In this method a hollow rivet or tubular slug is inserted into a clinched joint between sheets and the inner end of a shank of the rivet is outwardly deformed within the clinched joint in such a way that it does not penetrate the panels.

In both the above-described methods a C-frame is used to support the riveting apparatus and die. A lower limb of the C-frame supports the die and, in use, deflects a certain distance during the riveting operation as a result of the rivet insertion and clamping forces. This means that in hydraulic clamping systems top-up hydraulic fluid is generally required to maintain the required level of clamping. The slow response of hydraulic fluid systems to the demand for extra loading leads to relatively long cycle times.

It is an object of the present invention to obviate or mitigate the aforesaid disadvantages and to provide for an improved method and apparatus for fastening sheet material by self-piercing riveting or clinching.

According to a first aspect of the present invention there is provided a method for inserting a fastener into sheet material comprising inserting the fastener into at least one sheet without full penetration such that a deformed end of the fastener remains encapsulated by an upset annulus of the sheet material, the sheet material being disposed between a nose and a die of fastening apparatus and the fastener being inserted into the sheet material by means of a punch that is reciprocal relative to the nose, characterised in that, after the fastener is inserted the punch is retracted and a clamping force is applied to the sheet material between the nose and die in the region around the fastener insertion location so as to reduce deformation of the sheet out of its plane in the region around the fastener insertion location.

The clamping of the sheet after insertion of the fastener in this way ensures that favourable compressive stresses are built into the region around the fastener insertion location and, in the case where one or more sheets are being joined, also ensures that fatigue performance of the joints significantly improves in, comparison to joints produced by conventional fastening methods. Retraction of the punch ensures that clamping of the sheet after rivet insertion is applied only by the nose.

The nose may be supported by a support member, movement of the nose relative to the support member in a direction away from the die being prevented during the fastening operation.

The position of the nose in relation to the die is controlled such that very little or no local thickening or swelling of the sheets in the region around the rivet insertion location is permitted. The method means that the sheet material displaced during the rivet insertion operation is constrained within a substantially fixed distance between the nose and the die. This constraint results in increased residual compressive stress being induced into the joint area as a result of the rivet insertion, thereby providing improved fatigue life of the riveted joint.

The distance between the nose and the die is preferably controlled by restraining the nose of the riveting machine so that it is prevented from being pushed back away from the die during the riveting operation, regardless of the force applied. However in the event of deflection of a support frame (such as a C-frame) owing to rivet setting loads, the nose is still able to move so as to follow the die.

A clamping force may also be applied to the sheet material prior to or during insertion of the fastener.

Preferably the clamping force and the force required to insert the fastener are derived from the same actuator.

The clamping force applied after insertion of the fastener may be varied by varying the force applied to insert the fastener.

According to a second aspect of the present invention there is provided a apparatus for by inserting a fastener into sheet material without full penetration such that a deformed end of the fastener remains encapsulated by an upset annulus of the sheet material, said apparatus comprising a nose in which is disposed a reciprocal punch, means for feeding fasteners successively to the nose for insertion by the punch into the sheet material, a die aligned with the punch for deforming the fastener inserted, the sheet material being disposed between the nose and die during the fastening operation, the nose being supported by a support member, characterised in that there is provided means for retracting the punch into the nose after insertion of the fastener so that the punch does not project therefrom and means for applying a clamping force to the sheet material after insertion of the fastener, the force being applied between the nose and die in the region around the fastener insertion location so as to reduce deformation of the sheets out of their planes in the region around the fastener insertion location.

In one embodiment, when the punch has travelled its full extent and the rivet is inserted, a substantial reaction force will have been established in a supporting frame such as, for example, a C-frame. This force is an equal and opposite reaction to the force applied by the punch. With the nose position controlled, retracting the punch away, from the formed joint will result in the frame reaction load being transferred from the punch to the nose. This transfer of load results in the sheet material surrounding the rivet being squeezed between the nose and die with the same substantial force initially used to insert the rivet. Such post rivet-insertion clamping provides for increased residual compressive stresses being imparted into the joint utilising forces already available as a result of rivet insertion and hence removes the need for separate or additional loading. Further, post rivet-insertion clamping allows for the use of clamping forces ranging from zero to moderate during rivet insertion yet still achieves all of the advantages of a joint clamped with substantial force prior to rivet insertion and has been shown to exceed the fatigue results produced by using moderate or high clamping forces.

The restraint device is preferably connected to the nose so as to prevent movement of the nose away from the die during the riveting operation. It may take the form of a mechanical linkage connected between the nose and a fixed surface, the linkage being acted upon by an actuator so that its movement, and therefore movement of the nose away from the die is prevented during the riveting operation. However the device still allows the nose to follow die deflection.

Alternatively the restraint device may be a rotary nut threadedly engaged with a threaded surface of the nose, the nut being rotatable to enable movement of the nose towards and away from the die, rotation in one direction being prevented during the riveting operation so as to prevent movement of the nose away from the die. However, rotation in the other direction, allowing the nose to follow the die, is permitted.

In an alternative preferred embodiment the restraint device is a wedge member disposed between the nose and supporting frame, the wedge member being moveable between an operative position in which it prevents movement of the nose away from the die operation (but still allowing the nose to follow the die if required) and a released position in which such movement is permitted enabling the mechanism to be retracted at the conclusion of the cycle.

In a further alternative preferred embodiment the restraint device is provided by a supply of hydraulic fluid through an inlet connector to the riveting device, the hydraulic fluid applying pressure to control the movement of the nose towards the die, the inlet connector being fitted with a check valve or similar type device that prevents release of fluid pressure and therefore movement of the nose away from the die during the riveting operation.

According to a third aspect of the present invention there is provided a panel clinching method wherein two or more sheets of material are deformed into locking engagement, the sheet material being disposed between a nose and a die of fastening apparatus, the sheet material being deformed by means of a punch that is reciprocal relative to the nose, characterised in that, after the sheets are deformed by the punch, the punch is retracted and a clamping force is applied to the sheet material between the nose and die in the region around the punch insertion location so as to reduce deformation of the sheet out of its plane in the region around the punch in-sertion location.

Specific embodiments of the present invention will now be described, by way of example only, with reference to the accompanying drawings in which.

Figures 8A, 8B, 8C, 8D, 8E, 8F, 8G, 8H:
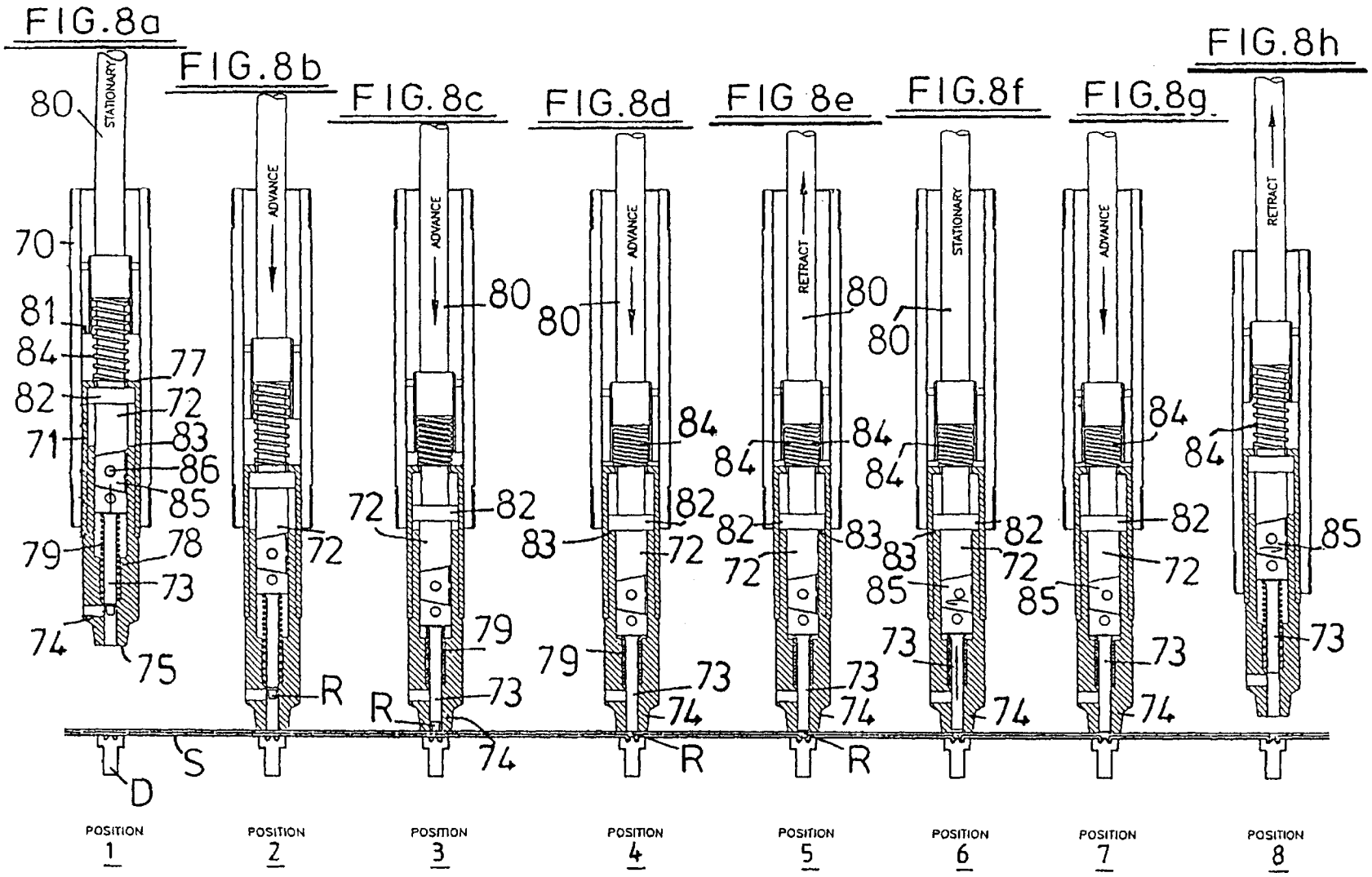
Figures 8I, 9A, 9B, 9C, 9D, 9E:
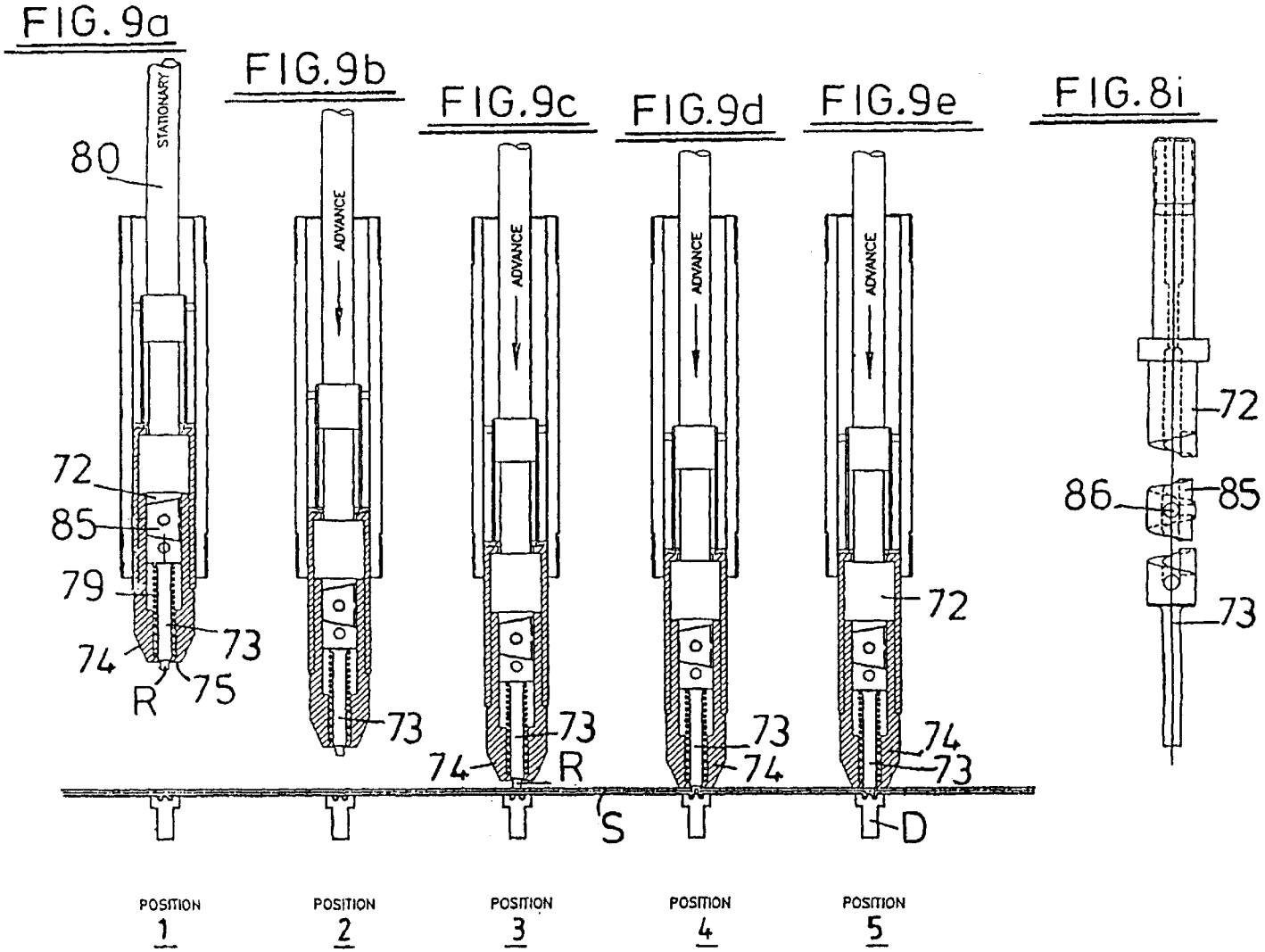

FIGS. 8*a* to 8*h* are longitudinal sectioned views of a rivet setter and die of the present invention showing in a sequence of chronological steps a method of fastener insertion in accordance with the present invention;

FIG. 8*i* is an exploded view of a plunger and punch assembly of the rivet setter of FIGS. 8*a* to 8*h* and 9*a* to 9*e*; and FIGS. 9*a* to 9*e* are longitudinal sectioned views of a rivet setter and die showing a chronological sequence of an alternative method of fastener insertion in accordance with the present invention.

Figure 1:
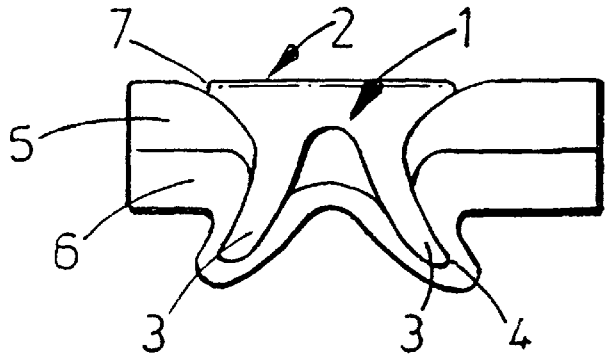
FIG. 1 is a section of a riveted joint made by the fastening method of the present invention.

Referring now to the drawings, the riveted joint of FIG. 1 has already been described as an example of the kind of joint that is produced by the fastening method of the invention.

Figure 3:
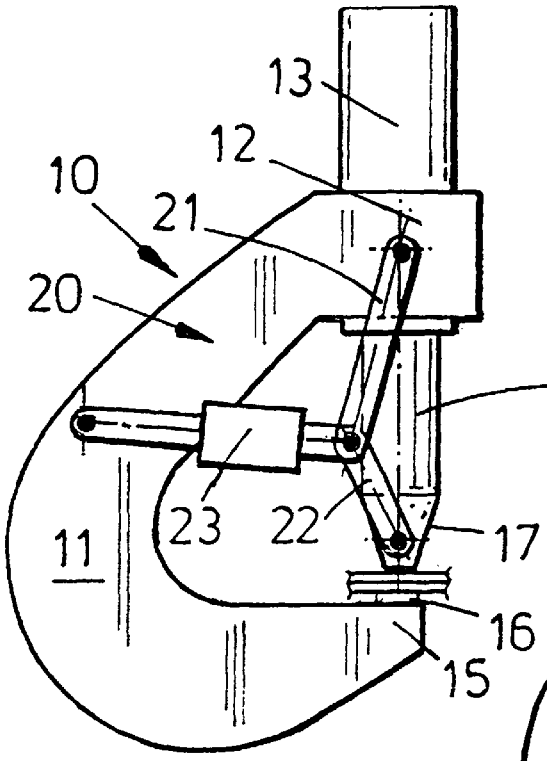
FIGS. 2 and 3 are diagrammatic illustrations of a first embodiment of a riveting machine of the invention shown mounted on a C-frame.
Figure 2:
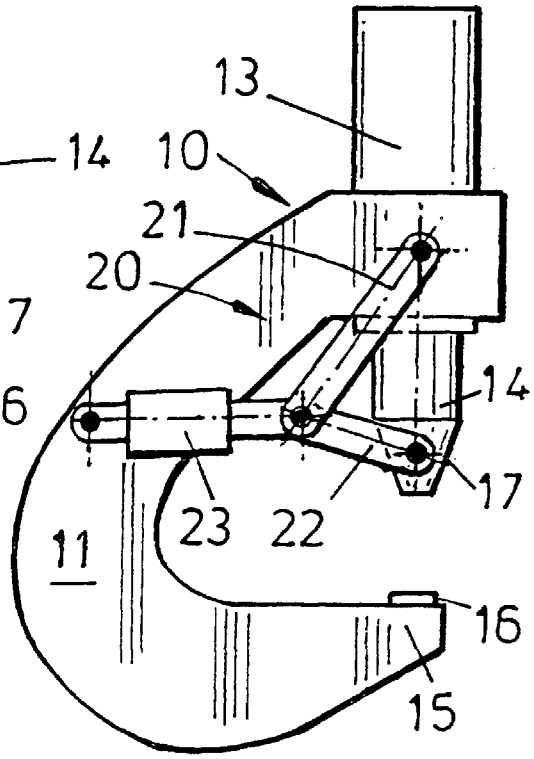

FIGS. 2 and 3 show a riveting machine 10 mounted on a conventional C-frame 11. An upper limb 12 of the C-frame 11 supports a fixed main cylinder 13 in which is received a retractable clamping cylinder 14 of the machine. The main cylinder 13 provides hydraulic pressure for actuation of the clamping cylinder and a rivet punch (not shown) that is coaxially slidable therein. A lower limb 15 of the C-frame 11 supports a die 16 directly below the clamping cylinder 14. The clamping cylinder 14 terminates in a nose 17 the end surface of which defines an annular clamping surface 18 that urges two overlapping sheets 19 against the die 16.

The movement of both the clamping cylinder 14 and the punch is driven by a hydraulic fluid pressure as is well known and discussed in our aforementioned European Patent. However, other punch drive mechanisms may be used such as an electrically powered screw assembly. Furthermore, the clamping cylinder may alternatively be driven by an electrically powered actuator or via a spring from the punch.

A mechanical linkage 20 is connected to the C-frame 11 and to the nose 17 in order to maintain the extension of the nose 17 towards the die 16 during the riveting operation. The linkage 20 comprises a first link member 21 fixed at one end to the upper limb 12 of the C-frame 11 and a second link member 22 connected to the nose 17, the two link members 21, 22 being pivotally interconnected at their other ends. The linkage 20 is controlled by an actuator 23 connected between the C-frame 11 at a location intermediate the upper and lower limbs 12, 15 and the pivot between the first and second link members 21, 22. In use, the linkage 20 moves in synchronism with the descent of the clamping cylinder 14, or, alternatively, is acted upon by the actuator 23 to advance the clamping cylinder 14, between an extended position, shown in FIG. 3, in which the nose 17 is in clamping contact with the sheets 19 and a contracted position, shown in FIG. 2, in which the nose 17 is retracted towards the upper limb 12 of the C-frame 11. The actuator 23 serves to drive and hold the mechanical linkage 20 in the extended position so that retraction of the nose 17 relative to the C-frame 11 is prevented until such time as the riveting process is complete and the clamping pressure is released whereupon the actuator 23 is released.

The riveting operation is performed as follows. A rivet of the kind shown in FIG. 1 is delivered to the end of the nose 17 in a conventional manner ready for insertion into the sheets 19. The clamping cylinder 14 descends downwards from the retracted position shown in FIG. 2 to the position shown in FIG. 3 and applies a light to moderate clamping force between the nose 17 and the die 16. The mechanical linkage 20 either extends simultaneously with, or drives the descent of the clamping cylinder 14 and a restraining force is applied by the actuator 23 to the linkage 20 so as to prevent reverse movement of the nose 17 during the riveting operation, thereby controlling the position of the nose 17 in relationship to the die 16. As soon as the pre-selected clamping force is reached a pressure switch or load cell etc. (not shown) signals the punch to advance for the riveting operation. The clamping force may be maintained throughout the rivet insertion or may be reduced or increased by means of varying the pressure in the actuator. The punch then descends within the clamping cylinder 14 to insert the rivet into the sheets 19.

The timing and co-ordination of above operation is conducted under the control of a programmable logic controller or a similar automatic control device. It will be understood that the riveting operation may be supplemented by the inclusion of a coining ring and/or an adhesive applied to the nose as described in our aforementioned European Patent.

Figure 4:
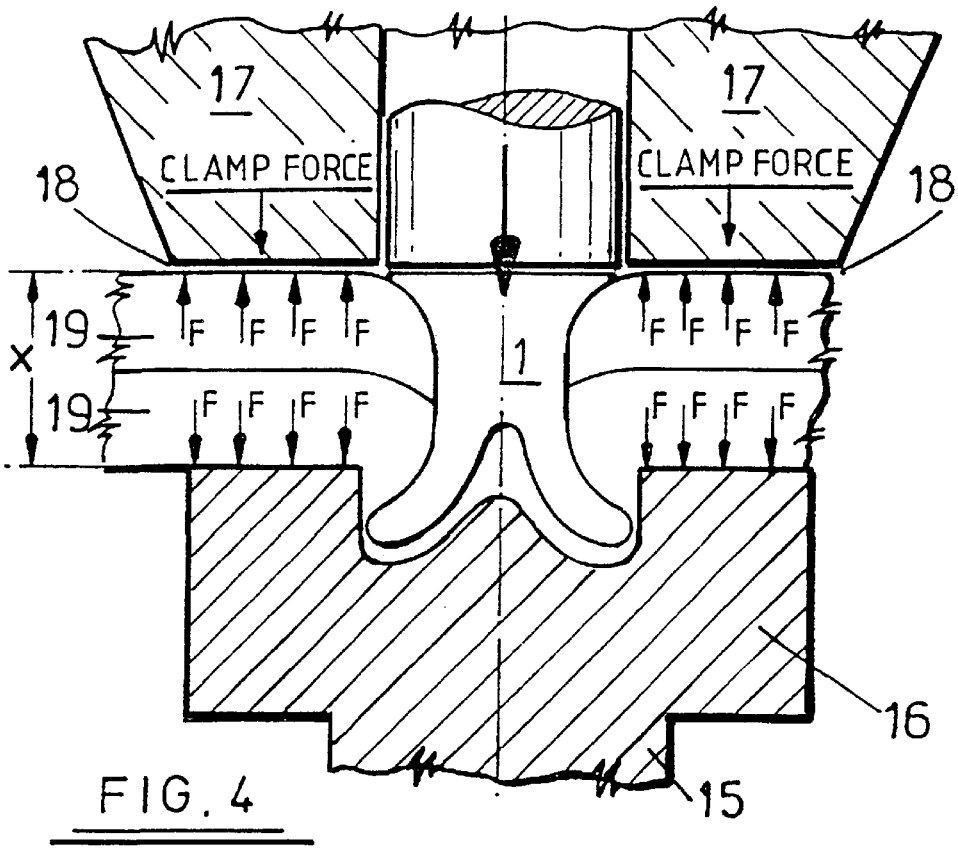
FIG. 4 is a diagram showing the internal stresses of a joint being riveted in accordance with the method of the present invention.

The insertion of the rivet is illustrated in FIG. 4. Whilst the clamping force is applied by the nose 17 to the sheets 19 there is a corresponding equal and opposite reaction force applied by the die 16 to the sheets 19. In addition to this there are -further reaction forces generated by the tendency of the sheets to deform as the rivet penetrates the sheets under action of the punch. Initially sheet material is drawn into the die cavity by the rivet as it is inserted. As the rivet is fully inserted and fills the die cavity sheet material is displaced out of the cavity. This displaced material generates reaction forces against the nose and the die. The reaction forces, illustrated by the arrows F in FIG. 4, exceed the clamping force and act against the nose 17 which would normally be deflected outwardly away from the die 16 by the reaction forces generated by the deformation of the sheets 19. However, since the nose 17 is restrained from moving away from the die 16 by operation of the linkage 20 when in the clamping position, it is not deflected and the joint is correspondingly compressed. The compressive stress applied during the riveting process provides the joint with improved fatigue life.

The advance of the punch during insertion of the rivet into the joint applies increased force to the sheets and the die 16 and lower limb 15 of the C-frame 11 tend to deflect slightly downwardly under the increased load. The deflection of the C-frame is followed by the nose 17 in order that the clamping force is maintained. The mechanical linkage 20 is able to extend slightly further to allow this additional travel of the nose 17. When the riveting force is removed, (i.e. the insertion of the rivet is complete and the punch is retracted into the nose) but whilst the clamping force is still maintained, the lower limb 15 of the C-frame 11 will attempt to spring back to an equilibrium position against the nose 17. In the absence of the linkage 20 the nose 17 would be deflected upwards until the force (applied by the clamping pressure) is equal to the reaction force of the lower limb of the C-frame. However, in the presence of the linkage 20 the nose 17 is not moveable relative to the C-frame and all of the reaction force from the riveting operation is thus transmitted via the die 16 back into the joint which becomes squeezed between the die 16 and nose 17 by a force which is substantial and approximately equal to the rivet insertion force (typically 2–5 tonnes less the initial clamping force). Since the punch is retracted fully into the nose the squeezing force is applied only by the nose. This results in both flattening of the joint and imparting of favourable compressive stresses providing advantageous strength and fatigue performance. After this post rivet-insertion 'squeeze' of the joint has been allowed to occur fully, the nose restraining device is disengaged so that it can retract ready for the next cycle.

The riveting method of the present invention allows for improved joint characteristics such as improved fatigue life without the need for a separately applied high clamping force. Research has established that initial clamping forces of zero or low to moderate such as 100 lbf or so are sufficient to ensure effective riveting using the method of the present invention although in practice higher or lower forces may be used. Moreover, additional top-up hydraulic fluid is not required to compensate for deflection of the C-frame.

Figure 7:
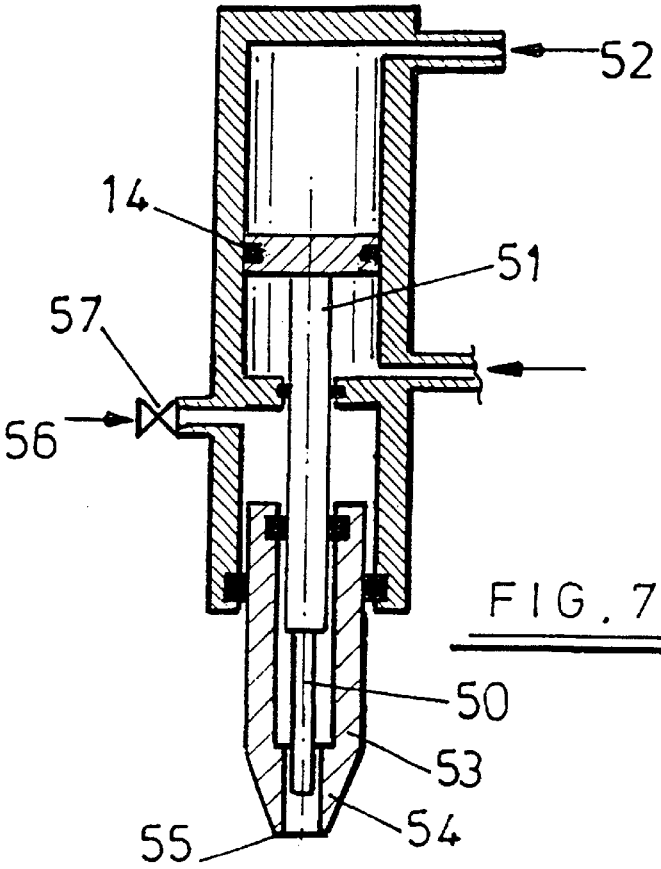
FIG. 7 is a diagrammatic representation of a fourth embodiment of a riveting machine of the present invention.
Figure 5:
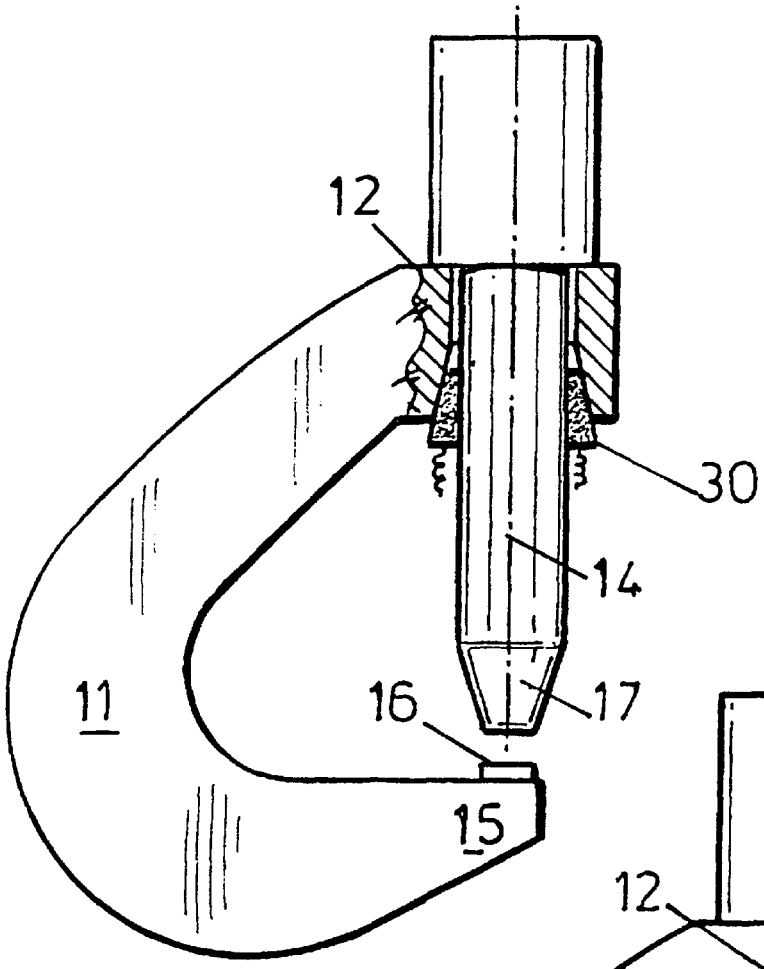
FIG. 5 is a diagrammatic side view of a second embodiment of a riveting machine of the present invention.
Figure 6:
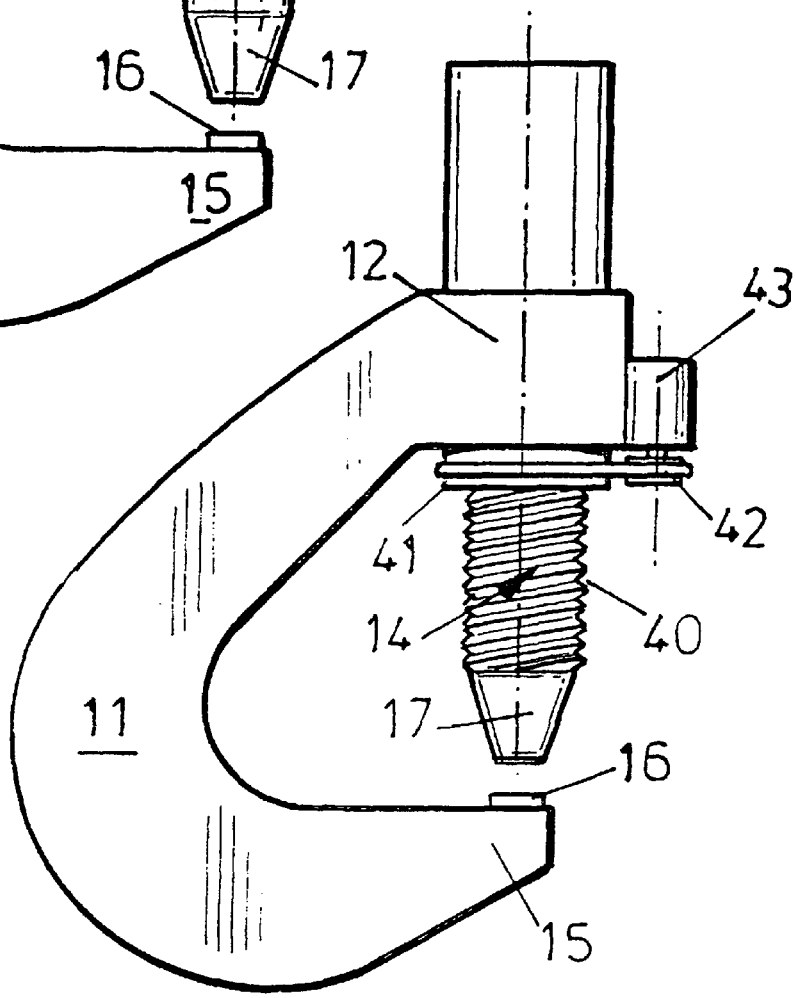
FIG. 6 is a diagrammatic side view of a third embodiment of a riveting machine of the present invention.

Alternative designs of riveting machines are shown in FIGS. 5, 6 and 7. Components identical to those of the previous figure are given the same reference numerals. In the example shown in FIG. 5 the mechanical linkage is replaced by a spring-loaded wedge-shaped collar 30 that is mounted between the upper limb 12 of the C-frame 11 and the clamping cylinder 14. The collar 30 permits descent of the clamping cylinder 14 but prevents any reverse motion by a jamming effect until riveting process is complete. When the rivet has been inserted into the sheets 19 and the clamping force is released the wedge-shaped collar 30 is moved out of engagement with the C-frame 11 so as to permit ascent of the clamping cylinder 14 and therefore movement of the nose 17 away from the riveted joint.

In the embodiment of FIG. 6 the main cylinder has an exterior screw thread formation 40 that engages with a complementary internal thread of a rotary nut 41 disposed immediately below the upper limb 12 of the C-frame 11. The nut 41 is drivingly connected via a belt 42 to a motor 43 that is supported on the side of the upper limb 12. In operation, the travel of the clamping cylinder 14 relative to the C-frame 11 is effected by rotation of the nut 41 by the motor 43. The nut 41 is rotated until the nose 17 is in a clamping position on the sheets. The threads are designed to be of shallow pitch so that they tend to lock to prevent reverse movement of the main cylinder 14 during the riveting operation. Alternatively, the clamping cylinder may be hydraulically or otherwise driven and the screw thread acts as a complimentary lock to prevent reverse movement.

The riveting machine of FIG. 7 is substantially similar to that described in our aforementioned European Patent No. 0675774. A punch 50 is carried by a plunger 51 and is slidable within the main cylinder 14 under the influence of hydraulic pressure admitted through an inlet connector 52 of the main cylinder. The lower part of the cylinder 14 houses a slidable clamping cylinder 53 that terminates in a nose 54 the end face of which provides a clamping surface 55. The clamping pressure is provided by hydraulic fluid admitted through an inlet connector 56 in the main cylinder 14. In order to retract the clamping cylinder 14 and release the clamping pressure, a check valve 57 located in the inlet connector 56 is opened and fluid is allowed to escape back through inlet connector 56. The machine differs from conventional designs in that the hydraulic check valve 57 (or an equivalent device) is located in or close to the inlet connector 56 so as to limit the volume of hydraulic fluid that is held at the clamping pressure. This serves to restrain upward movement of the nose 54 and so enables the distance between the nose 54 and the die to be controlled.

It is to be understood that all the above designs can prevent the lower limb of the C-frame springing back to its equilibrium position after the riveting force is removed as described above in relation to the embodiments shown in FIGS. 2 and 3.

In a further alternative embodiment (not shown) a single actuator (for example a hydraulic cylinder or an electric motor) drives both the punch and nose. Once the nose contacts the sheets to be joined a relatively light spring force (e.g. 20 lbf) is applied whilst the punch continues to advance within the nose. The punch comes into contact with a rivet that has been delivered to the nose and drives it into the sheets. At the moment the rivet comes into contact with the upper sheet there is still only a relatively low clamping force being applied to prevent rattling of the riveting machine relative to the sheets. This very low force allows the sheet material being joined to flow so that it is dragged towards the die and into the die cavity by the advancing rivet resulting in the material immediately around the rivet being deformed into an annular valley. This occurrence allows more sheet material to flow into the die and results in relatively low tensile stresses being set up in the sheet material in the region around the rivet insertion location. As the head of the rivet is pressed flush with the upper surface of the top sheet a shoulder or stop on the punch abuts a complementary shoulder on the nose and prevents further travel of the punch relative to the nose. Thus any additional force applied by the actuator to the punch is shared between the punch and nose and serves to increase the clamping force between the nose and punch combination and the die. Both the rivet insertion force and the clamping force cause the lower limb of the C-frame to deflect as discussed above and this deflection is maintained as long as the punch remains in the extended position.

At a predetermined time after the rivet insertion stroke of the punch is complete, the punch is retracted whilst the nose is retained in position using any appropriate restraining mechanism such as any one of those described above. The force applied by the actuator is now applied to the joint solely by the end surface area of the nose and C-frame reaction pushes the die and sheets towards the fixed nose so as to clamp or "squeeze" the sheets in the region around the rivet insertion location. Since the punch is retracted no load is imparted to the rivet at this point. This squeezing serves to flatten out the distortion of the sheets out of their planes that occurred during rivet insertion in the region around rivet insertion. In addition, it imparts compressive stresses into the sheet material around the rivet shank. Once the squeezing force has stabilised the nose is then retracted as before and the punch is reset for the next stroke.

The amount of clamping or squeezing force can be varied in several ways. The clamping force may be increased in magnitude by increasing the actuator load prior to lifting the punch once the rivet has been inserted. This does not drive the rivet further into the sheet material as advance of the punch relative to the nose is prevented by the abutting shoulders. The additional load is thus imparted to the C-frame which deflects further. Once the punch is retracted the C-frame reacts and the load is transferred into clamping of the joint. Similarly, the clamping force may be reduced by reducing the actuator load prior to retraction of the punch so that a lower force is reacted by the C-frame and imparted into the joint. The clamping force can be measured by means of a load cell associated with the actuator so that the load applied by the actuator can be controlled to achieve the required clamping force. This arrangement is advantageous as no additional stroke or loading of the actuator is required to impart the clamping force, thereby saving on cycle time and power.

The duration of the clamping force imparted into the joint is dependent on the stiffness of the C-frame and the control device (referred to above) is designed to take such factors into account during a preliminary calibration stage that establishes the required actuator load for a desired clamping force and a given C-frame stiffness.

By reducing the initial clamping force (i.e. that prior to rivet insertion) in favour of a post rivet-insertion force the impact on the nose of the riveting apparatus is reduced. In the embodiment described above the clamping force may be increased gradually in stages during and/or after rivet insertion thereby reducing the risk of impact damage to the nose. Furthermore, as the clamping force and the rivet insertion force are applied via the same actuator only a single supply of hydraulic fluid is required. This eliminates the need for a two-stage operation of clamping then riveting as in existing riveting apparatus. Such a single stage operation is ideally suited to electric actuators that hitherto have proven unsuitable for riveting operations in that the joints produced have been of poor quality.

The rivet setter and die shown in FIGS. 8*a* to 8*i* has a single actuator and can be used in the embodiment described immediately above or may be used in such a way that the clamping force is imparted to the sheet material joint after rivet insertion in a different manner as will now be described. The operation of the apparatus is shown as a series of chronological steps.

A cylindrical support tube 70 carries a clamping cylinder 71 that is coaxially slidable therein. The clamping cylinder 71 in turn supports internally a coaxial plunger 72 that is slidable therein and carries a punch 73. The lower part of the clamping cylinder 71 terminates in an external nose 74 the end face 75 of which provides a clamping surface for the sheet material 5. The upper end of the clamping cylinder 71 defines an annular abutment shoulder 77 the purpose of which will be described below. The nose 74 is internally configured to define a guide bush 78 of relatively narrow diameter that receives the punch 73 in coaxial alignment and guides the punch 73 during relative sliding movement thereof against the bias of a coaxial punch spring 79. In the relaxed condition the punch spring 79 urges the punch 73 away from the outlet of the nose 74.

The plunger 72 is moveable in the clamping cylinder 71 by means of the shaft 80 of a linear actuator (not shown) the end of which supports an annular shoulder 81 for abutment with the shoulder 77 on the clamping cylinder 71. The respective shoulders 77, 81 serve to limit the extent of travel of the actuator shaft 80 in the support tube 70. Inside the clamping cylinder 71 the plunger 72 has a radially outwardly defined step that serves as a stop 82 that, in use, co-operates with an abutment shoulder 83 at the top of the guide bush 78 so as to limit the extent of travel of the plunger 72. A compression spring 84 is coaxially disposed between the actuator shaft 80 and the top of the clamping cylinder 71.

Interposed between the plunger 72 and the punch 73 is a rotary cam 85 that is actuable to allow the punch 73 to retract slightly into the nose 74 under the influence of the punch spring 79 as will be described below. The cam 85 is mounted on a pin 86 that rides in a slot (not shown) during reciprocal motion of the plunger 72 and punch 73. When it is desired to retract the punch 73 the cam 85 is rotated about the longitudinal axis of the rivet setter so as to reduce the distance between the proximate ends of the plunger 72 and punch 73. The slot is configured to allow such rotation to occur at a predetermined axial distance along the rivet setter.

At rest the actuator shaft 80, plunger 72 and punch 73 are retracted in the rivet setter as shown in FIG. 8*a* In order to effect rivet insertion, the actuator shaft 80 is first advanced into the support tube 70 thereby forcing the clamping cylinder 71 to extend until the nose 74 is in contact with the sheet materials as shown in FIG. 8*b*. The nose 74 is now prevented from further movement and continued advance of the actuator shaft 80 compresses the compression spring 84 between the actuator shaft 80 and the plunger 72. The only clamping force applied to the sheet material around the rivet insertion location at this stage is that applied by the compression spring 84. The advance of the actuator shaft causes movement of the plunger 72 within the clamping cylinder 71 which in turn urges the punch 73 to move against the biasing force 79 of the punch spring into contact with a rivet R supplied through a side port in the nose 74 (see FIG. 8*c*). Further advance of the actuator shaft 80 forces the rivet R into the sheet materials as shown in FIG. 8*d*. During the final stages of full insertion of the rivet R the stop 82 on the plunger 72 comes into abutment with the shoulder 83 at the top of the guide bush 78 and any additional force applied by the actuator is evenly distributed across the nose and the punch as a late clamping force. The actuator shaft 80 is then retracted a short distance until the load applied by the punch to the rivet R is removed at which point there is still a small clamping force applied by the nose by virtue of the action of the compression spring 84 (FIG. 8*e*). When the punch 73 is unloaded the actuator stops and the cam 85 is rotated by an external actuator or a biasing spring (not shown) to allow the punch 73 to retract slightly (under the influence of the punch spring 79) into the nose 74 so that it no longer projects therefrom (FIG. 8*f*).

The actuator is then operated a second time so as to advance the shaft 80 again until the stop 82 on the plunger 72 abuts the shoulder 83 of the guide bush 78 (FIG. 8*g*). As a result of the orientation of the cam 85 the punch 73 no longer extends out of the nose 74 and therefore does not contact the set rivet. Thus all the force applied by the actuator is transferred to the sheet materials via the clamping surface of the nose only. The force applied by the actuator may be increased gradually until the desired clamping force is achieved. Finally, the actuator shaft is retracted to the start position and the cam is reset.

This method of applying a post rivet-insertion clamping force is advantageous in that the force is imparted is not dependent on the C-frame stiffness. The required post rivet-insertion force is applied by simply advancing the nose and driving deflection into the C-frame until the required clamping load is attained regardless of the distance of travel of the lower limb of the C-frame. A load cell is associated with the actuator in such a way as to measure the applied force is used to feed control signals to a control system that governs the actuator advance. The control system can be self-calibrating.

In a modified approach the actuator shaft 80 may be held in position at the full extent of the rivet insertion stroke and the cam 85 rotated by an external actuator whilst the punch 73 is still loaded with the full rivet insertion force. This operation effectively transfers all the force used to insert the rivet R into additional clamping force applied only by the nose without the need for a separate descent of the actuator shaft.

In a modified design a disc spring (not shown) may be supported on the abutment shoulder 77 of the clamping cylinder 71. Towards the end of the stroke of the actuator shaft 80 its abutment shoulder 81 comes into contact with the disc spring and further advance requires a force to overcome the bias of the disc spring. This force is transferred to the clamping cylinder 71 so that at the end of the rivet insertion this spring will have the effect of providing an additional clamping force during the final stages of rivet insertion. This is desirable as the flow of sheet material out of the die cavity is restrained whilst the rivet is still moving during the final stages of insertion and helps to build compressive stresses into the material around the rivet insertion location and this improve fatigue life of the resulting joint.

It will be appreciated that the retraction of the punch may be effected by any appropriate device instead of the cam.

The same apparatus may be used to insert a rivet into sheet material without any clamping force prior to rivet insertion but with a selected clamping force during the final stages of rivet insertion. In such an operation the rivet R is inserted into the end of the nose 74 such that it projects therefrom (see FIG. 9*a*). The clamping cylinder 71 descends as before and the rivet R is inserted without any downward movement of the plunger 72 and punch 73 (see FIGS. 9*b* to 9*d*). When the rivet shank is fully inserted and the rivet head is just contacting the upper surface of the sheet material 5 (see FIG. 9*d*) the nose clamping surface 75 comes into contact with the sheet material 5 and imparts a clamping force that is dependent of the characteristics of the disc spring (if fitted). The plunger 72 and punch 73 then travel as before to insert the rivet R fully into the sheet material 5. The clamping force reaches its maximum when the disc spring (if fitted) is fully compressed between the abutment shoulders 81, 77 of the actuator shaft 80 and clamping cylinder 71 and the plunger stop 82 abut the shoulder 83 of the guide bush 78. The post rivet-insertion clamping force is then applied, if required, as described above.

In all embodiments the post rivet-insertion clamping force and the insertion force are applied at separate stages in the riveting cycle and thus can be measured using a single transducer such as a load cell. Moreover, since the forces are never simultaneously applied to the C-frame the peak loading of the frame is never more than the highest of the two forces. This is in contrast to existing technology where the insertion and principal clamping loads are applied simultaneously for at least part of the riveting cycle.

Tests have established that for some joint types a significant reduction in the clamping force prior to rivet insertion can allow for a reduced rivet insertion force. Joints made in relatively thick sheets may be best suited to low or zero clamping force prior to rivet insertion and a relatively high post rivet-insertion clamping force. In thinner joints a low to moderate clamping force prior to rivet insertion may be necessary. The present invention allows for the clamping force both prior to, during and after rivet insertion to be selected and controlled according to the particular joint being formed. The clamping force during rivet insertion may be varied as described above by applying a relatively high clamping force as the head of the rivet moves flush with the sheet material. If no clamping force is required prior to insertion the nose need not be advanced with the punch before or during rivet insertion. This means that the nose of the apparatus may be made considerably shorter in length as it is only required to apply a clamping force after rivet insertion.

It is to be understood that the present invention has application to clinching technology such as that described in our aforementioned European Patent No. 0614405.

It will be appreciated that numerous modifications to the above-described designs may be made without departing from the scope of the invention as defined in the appended claims. For example, the main cylinder in the embodiment of FIG. 6 may alternatively have an internal screw thread engaged by a drive mechanism to control advancement Furthermore, the embodiment described in relation to FIGS. 2 and 3 may be modified such that the actuator 23 serves to hold the mechanical linkage 20 with the aid of mechanical advantage, or the linkage 20 may be moved to a position where it travels over-centre and locks the linkage in place. The hydraulic locking device described earlier may be used in conjunction with a clamping cylinder that is moved under the influence of a spring force.

It is to be understood that the present invention has application to a hand-held riveting or clinching gun. Moreover, the method of inserting a fastener of the present invention can be used not only in applications in which two or more sheets of material are to be joined but also has application to the insertion of a fastener, such as a stud, into a single sheet of material. Such a stud may be used as a fixing to connect to another component.

The invention may be used in conjunction with a self-piercing rivet insertion actuator that operates to drive the rivet by multiple impacts at a pulsated excitation frequency such as that described in European Patent Application EP-A-0890397.

What is claimed is:

1. A method for inserting a fastener (1) into sheet material (5, 6) comprising inserting the fastener (1) into at least one sheet without full penetration such that a deformed end of the fastener remains encapsulated by an upset annulus of the sheet material, the sheet material (5, 6) being disposed between a nose (17) and a die (16) of fastening apparatus (18) and the fastener (1) being inserted into the sheet material by means of a punch that is reciprocal relative to the nose (17), characterized in that a first clamping force is applied to the sheet material during fastener insertion between the nose and die in the region around the fastener insertion location, and in that after the fastener is inserted the punch is retracted and then a second clamping force is applied to the sheet material (2, 3) between the nose (17) and die (16) in the region around the fastener insertion location so as to reduce deformation of the sheet out of its plane in the region around the fastener insertion location.

2. A method for inserting a fastener according to claim 1, the nose (17) being supported by a support member (20), characterized in that movement of the nose (17) relative to the support member (20) in a direction away from the die is prevented during the fastening operation.

3. A method for inserting a fastener according to to claim 1, wherein a clamping force is also applied to the sheet material (5, 6) prior to the fastener being inserted.

4. A method for inserting a fastener according to claim 1, wherein the second clamping force and the force required to insert the fastener (1) are derived from the same actuator.

5. A method for inserting a fastener according to claim 1, wherein the second clamping force applied after insertion of the fastener (1) is varied by varying the force applied to insert the fastener (1).

6. A method for inserting a fastener according to claim 1, wherein the punch is retracted whilst the sheet material is under load by the first clamping force.

7. A panel clinching method wherein two or more sheets of material (5, 6) are deformed into locking engagement, the sheet material being disposed between a nose (17) and a die (16) of fastening apparatus, the sheet material (5, 6) being deformed by means of a punch that is reciprocal relative to the nose (17), characterized in that a first claming force is applied to the sheet material during fastener insertion between the nose and die in the region around the fastener insertion location, and in that after the sheets are deformed by the punch, the punch is retracted and then a second clamping force is applied to the sheet material between the nose (17) and die (16) in the region around the punch insertion location so as to reduce deformation of the sheet (5, 6) out of its plane in the region around the punch insertion location.

* * * * *